US006402110B1

(12) United States Patent
Berman et al.

(10) Patent No.: US 6,402,110 B1
(45) Date of Patent: Jun. 11, 2002

(54) APPARATUS AND METHOD FOR MOUNTING FLEXIBLE SHEET MATERIAL TO A SUPPORT STRUCTURE

(75) Inventors: Joel Berman, Hewlett; Vincent J. Brown, Valley Stream, both of NY (US)

(73) Assignee: Joel Berman Associates, Inc., Long Island City, NY (US)

( * ) Notice: Subject to any disclaimer, the term of this patent is extended or adjusted under 35 U.S.C. 154(b) by 0 days.

(21) Appl. No.: 09/408,228

(22) Filed: Sep. 29, 1999

(51) Int. Cl.[7] ..... A47G 1/10
(52) U.S. Cl. ..... 248/316.2
(58) Field of Search ..... 248/316.2; 24/459, 24/460, 462; 160/84.01, 84.03, 84.04, 84.06, 264, 348, 349.1, 349.2, 392, 395

(56) References Cited

U.S. PATENT DOCUMENTS

| | | | | | |
|---|---|---|---|---|---|
| 1,321,800 | A | | 11/1919 | Andress et al. | |
| 4,107,826 | A | | 8/1978 | Tysdal | |
| 4,279,064 | A | * | 7/1981 | Simme | 160/392 |
| 4,341,255 | A | * | 7/1982 | Mock | 160/392 |
| 4,542,602 | A | | 9/1985 | Hoverson | |
| 4,694,545 | A | | 9/1987 | Dernis | |
| 4,920,714 | A | * | 5/1990 | Sease | 160/392 |
| 5,207,256 | A | | 5/1993 | Kraeutler | |
| 5,273,096 | A | | 12/1993 | Thomsen et al. | |
| 5,320,154 | A | * | 6/1994 | Colson et al. | 160/300 |
| 5,355,928 | A | * | 10/1994 | Robertson | 160/84.01 |
| 5,398,436 | A | * | 3/1995 | Suzuki | 160/399 |
| 5,408,770 | A | * | 4/1995 | Suzuki | 160/368.1 |
| 5,566,735 | A | | 10/1996 | Jelic | |
| 5,586,400 | A | * | 12/1996 | Moore, III | 160/380 |
| 5,690,156 | A | | 11/1997 | Ruggles | |
| 5,799,715 | A | | 9/1998 | Biro et al. | |
| 5,862,850 | A | | 1/1999 | Yang | |
| 6,088,942 | A | * | 7/2000 | Brooks et al. | 160/328 |

FOREIGN PATENT DOCUMENTS

| | | |
|---|---|---|
| EP | 0 451 912 A1 | 10/1991 |
| WO | WO 98/20226 | 5/1998 |

* cited by examiner

*Primary Examiner*—Daniel P. Stodola
*Assistant Examiner*—Jennifer E. Novosad
(74) *Attorney, Agent, or Firm*—Snell & Wilmer, L.L.P.

(57) ABSTRACT

The present invention provides a sheet material mounting device having two channels, namely, a mounting channel for receivably engaging a rod for gripping the sheet material and a spacer channel for receivably engaging a spacer support configured to engage a lift cord and, optionally, a spacer cord. The spacer channel may be positioned above the mounting channel such that the center of gravity of the mounting device is located above the center of the mounting channel, thereby reducing asymmetric tilt of the sheet material engaged by the mounting channel and reducing friction against the lift cord. Alternatively, the mounting channel may be positioned above the spacer channel. The mounting channel and the spacer channel are preferably both C-shaped, and each channel has an opening which faces in a direction opposite the direction faced by the opening of the other channel. Thus, a side view of the mounting device may resemble either an "S" or a reverse "S".

9 Claims, 6 Drawing Sheets

APPARATUS AND METHOD FOR MOUNTING FLEXIBLE SHEET MATERIAL TO A SUPPORT STRUCTURE

TECHNICAL FIELD OF THE INVENTION

The present invention relates generally to an apparatus and method for mounting sheet material to a support structure and more particularly, to an apparatus and method for gripping and/or lifting lengths of flexible sheet material in a window covering system such as a Roman shade window covering system.

BACKGROUND OF THE INVENTION

The prior art contains various devices for mounting, lifting and folding flexible sheet material in association with blinds, curtains, draperies and other window coverings. Some of these window shade devices in the prior art include guide cables and lift cords in conjunction with a fabric gripping device. These cables/cords are typically threaded through rings sewn to the shade fabric. Alternatively, the cables/cords are threaded through apertures in the fabric pleats, wherein the pleats may be formed or stiffened with slats. The lattice formed by the attachment of the shade fabric to these guide cables and lift cords constitutes a mobile support structure which allows the shade to travel between raised and lowered positions.

Roman shades are a particular type of window covering which incorporates a mobile support structure such as a lattice for gathering sheet fabric into substantially horizontal folds. One example of the construction of a contemporary Roman shade is a cloth fabric hanging from a head rail, with a lower end having weights at predetermined lateral intervals. This type of Roman shade can be raised by drawing up a lift cord such that large, loose folds in the fabric are formed at approximately equal vertical distances to provide a neatly pleated aesthetic appearance. A common configuration for connecting the cord to the shade is to sew at least two sets of rings or connectors in vertical lines along the back of the fabric material as shown in U.S. Pat. No. 1,321,800 entitled CURTAIN HANGER issued to Andress, et al. on Nov. 18, 1919. In this type of Roman shade, a lift cord passes from a head rail through each set of rings and is then either fastened to the bottom edge of the fabric or wrapped around tho bottom edge of the fabric and returned up the front face of the shade to the head rail. Alternatively, each set of rings or connectors is sewn to the sheet fabric and attached to a lift cord at predetermined vertical intervals. As the shade travels through raised positions, the interval between the connectors may be reduced.

However, due to the extensive time and labor to sew connectors to the back of the sheet material of a Roman shade, the art has developed other methods and devices to connect sheet fabric to a mobile support structure. In the shade system disclosed in U.S. Pat. No. 4,694,545 entitled ATTACHMENT OF RINGS WITHOUT SEWING issued to Dernis on Sep. 22, 1987, a set of U-shaped filaments are inserted through the fabric from the front face, The ends of each filament are gathered in a tube, bent over the end of the tube and held in place by a sleeve that fits over the tube.

Another alternative for attachment includes one or more horizontal ribs to provide support and to maintain spacing between the cords which are oriented vertically across the back of the fabric. For example, in U.S. Pat. No. 5,207,256 entitled SAFETY DEVICE FOR A RAISABLE CURTAIN DOOR issued to Kraeutler on May 4, 1993, the ribs are placed in vertically spaced, transverse pockets in the sheet material. However, in this system, the pockets must be sewn into the sheet material, thereby substantially adding to the time, effort and expense of manufacture.

U.S. Pat. No. 5,273,096, entitled APPARATUS FOR GRIPPING SHEET FABRIC issued to Thomsen et al. on Dec. 28, 1993, discloses a tubular member having a longitudinal opening which receives the fabric and a rod, thereby gripping the fabric between the member and the rod. The backside of the tubular members each include loops through which the lift cords pass. However, as shown in FIG. 10, if this system is used on a Roman shade for a large window, the combined weight of the tubular member and the rod will often cause tilting of the mounting device, thereby adding substantial friction to the lift cord and making it more difficult to raise the shade. More particularly, the fabric mounting device found in Thomsen et al. and other Roman shade systems employ designs wherein the center of gravity of the fabric mounting device causes the device to tilt asymmetrically as the shade is raised, distorting the fabric being held and thereby adding friction to the lift cord. Thus, the size of a Roman shade is often limited by the friction incident upon the lift cord caused by the tilting of one or more of the rings, connectors, loops or spacers used to mount the fabric to the lift cord.

A need exists for a light-weight, sheet-material gripping apparatus which can be quickly assembled by the manufacturer and which includes both light-weight and inexpensive spacers that can be connected to the sheet material without sewing. Moreover, the gripping apparatus components should reduce the lift cord friction which often increases asymmetric tilting of the sheet-material connectors as the apparatus is raised. To satisfy this long felt need, the present invention provides a sheet-material mounting method and apparatus which substantially reduces lift cord friction while simultaneously giving a much neater and cleaner aesthetic appearance to the stacking of the sheet-material pleats.

SUMMARY OF THE INVENTION

The present invention provides a sheet material mounting device which includes two channels, namely a mounting channel for receivably engaging a rod for gripping the sheet material and a spacer configured to engage a lift cord and, optionally, a spacer cord. By preferably positioning the spacer channel above the mounting channel, the center of gravity of the mounting device is positioned over the center of the mounting channel where the sheet material is held securely in place, thereby reducing the asymmetric tilt of the sheet material and reducing friction against the lift cord. The mounting channel preferably resembles a reverse "C" while the spacer channel is positioned above the mounting channel and preferably resembles a forward "C". Thus, the configuration of the mounting device preferably resembles a reverse "S".

BRIEF DESCRIPTION OF THE DRAWINGS

The features and advantages of the present invention reside in the details of construction and operation as more fully depicted, described and claimed below, with particular reference to the accompanying drawings, wherein like numerals refer to like parts throughout:

DETAILED DESCRIPTION OF PREFERRED EXEMPLARY EMBODIMENTS

The present invention preferably includes an apparatus and method for reducing a shade clamp's 1 tilt and reducing the excess friction between the shade clamp 1 (or channel guide) and the lift cord. One skilled in the art will appreciate that the shade clamp 1 is any device or combination of devices suitably configured to hold sheet material 60. For example, any clamp, clip, ring, fastener, mechanical device, electrical device, magnetic device, VELCRO™ device and/or the like. Moreover, the shade clamp is comprised of any suitable material which provides sufficient characteristics for holding the sheet material, such as, for example, any type or combination of plastic, metal, rubber, wood, magnet, textile, glass and/or the like. Further, one skilled in the art will appreciate that the sheet material 60 is any material capable of being held by shade clamp 1, such as, for example, any type or combination of cloth, textile, roman shade, pleated roman shade, wood, metal, animal skin, plastic, mesh, weave and/or the like. In a preferred embodiment, sheet material 60 is a piece of material in the form of a roman shade.

Figure 13:
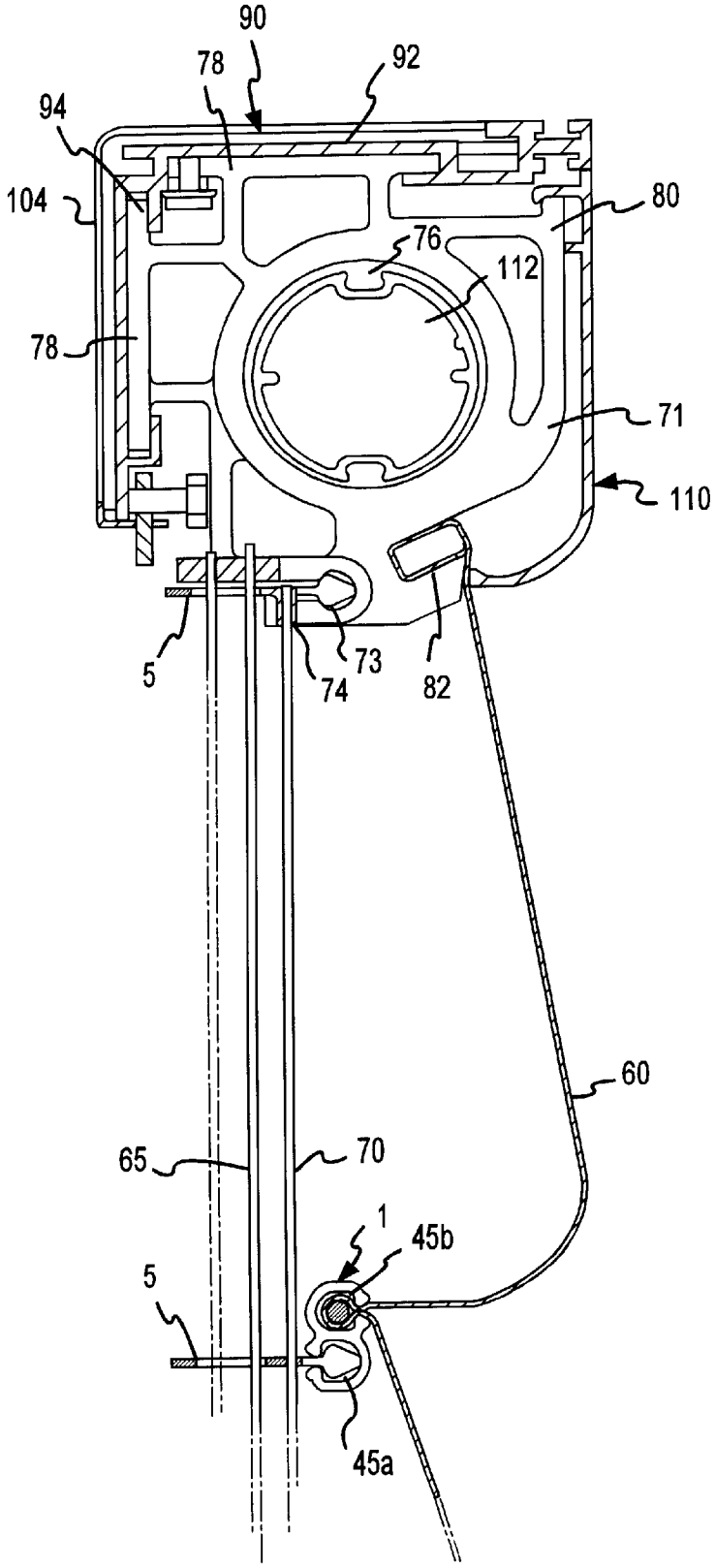

The support structure is any structure capable of supporting the shade clamp and material such as a headrail, cord and/or spacers. With respect to FIG. 13, an exemplary shade system is disclosed which preferably includes shade clamp 1 (only one shown), housing 90, center bracket 71, lift tube 112, facie 110 and other components of the system which will be described in more detail below. The present system may be used in conjunction with any shade operator device, such as a wrap spring shade operator as in "Wrap Spring Shade Operator" with inventors Joel Berman, Vincent J. Brown, Victor Erlikh and John Wilk filed on Aug. 23, 1999 having U.S. Ser. No. 09/379,065, the entire application is incorporated herein by reference.

Figure 1:
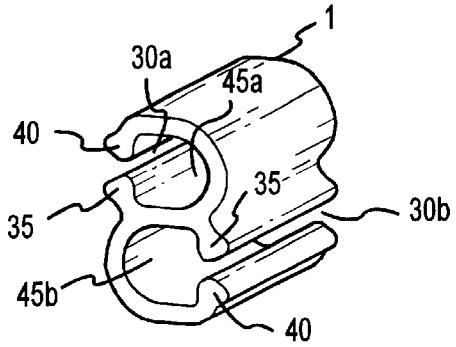
FIG. 1 is a three-quarter perspective view of an exemplary shade clamp according to one embodiment of the present invention.

One embodiment of shade clamp 1 for gripping and mounting flexible sheet material 60 to a hanging support structure is shown in FIG. 1. The S-shaped shade clamp 1 is preferably rotationally symmetric about the central axis of clamp 1 and has opposed channels 45*a*, 45*b*, wherein, mounting channel 45*b* reciprocally receives a welting of sheet material 60 and spacer channel 45*a* receives a spacer support 5, shown in FIG. 4. The clamp 1 preferably includes interior retaining lips 35 and peripheral retaining lips 40, wherein an interior and peripheral retaining lip pair secures the welting of sheet material 60 or the spacer support 5 within opposed channels 45*a*, 45*b* by restricting the exit path. Each interior lip 35 and peripheral lip 40 pair defines opposed lateral openings 30*a*, 30*b* which provide access to opposed channels 45*a*, 45*b*, respectively. The welting of sheet material 60 is releasably nested in the mounting channel 45*b* with a positive pressure against the inside surface of the channel requiring no fisher tension or clamping. The interior lip 35 and peripheral lip 40 of the mounting channel lateral opening 30*b* serve the dual purpose of preventing random release of the secured welting and providing for the neat pinching of the exterior sheet material so as to obscure the view of rod 10, shown in FIG. 3 within the mounting channel 45*b*. In a preferred embodiment, the welting of sheet material 60 and the spacer support 5 are removably held within opposing channels 45*a*, 45*b* by interior lip 35 and peripheral lip 40; however, those skilled in the art will also recognize various other means and methods that may be alternatively or conjunctively used within the scope of the present invention, such as any device or combination of devices suitably configured to restrict the exit path of material 60 or spacer support 5. For example, a release pin, clasp, snaps, adhesive and/or the like.

Figure 2A:
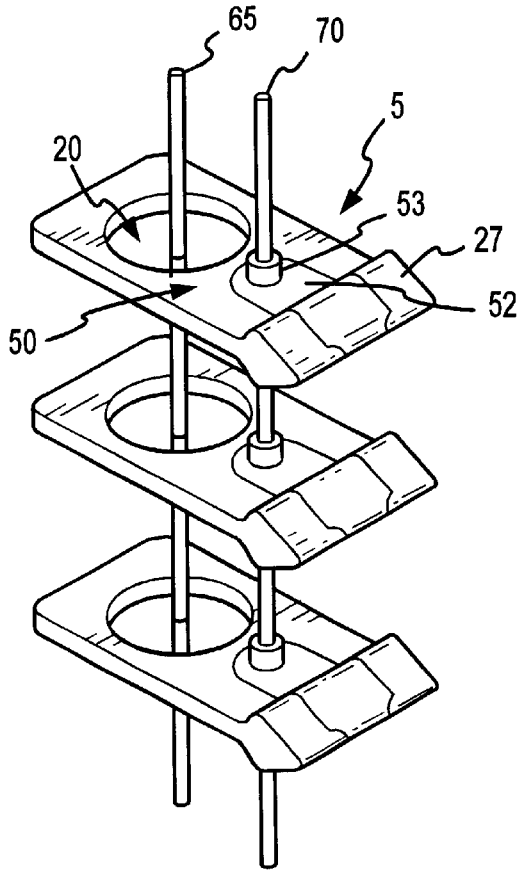
FIG. 2A is a perspective view of an exemplary spacer according to one embodiment of the present invention.
Figure 2B:
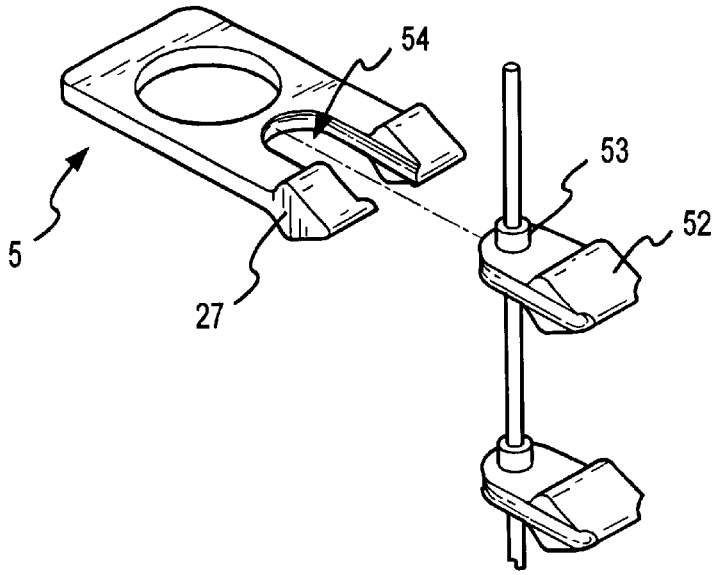
FIG. 2B is a perspective view of an exemplary spacer with the lug portion removed according to one embodiment of the present invention.

As shown in FIGS. 2A and 2B, spacer support 5 is configured for guiding the lift/guide cord 65, optionally attaching to spacer cord 70 and being receivably engaged by spacer channel 45*a*. As best shown in FIG. 2A, the spacer support 5 has an enlarged cylindrical end 27 which tapers down on its outside edge, thereby forming an arrowhead like configuration. Cylindrical end 27 is configured for nesting within spacer channel 45*a* between the inside surface of channel 45*a*, the interior channel lip 35*a* and the peripheral channel lip 40*a*. Those skilled in the art will also recognize various other means and shapes that may be alternatively or conjunctively used which are considered as being within the scope of the present invention, such as any device or combination of devices suitably configured to engage the spacer channel 45*a*. For example, a pin, rod, clasp, adhesive, and/or the like. Moreover, spacer support 5 can be integral with shade clamp 1 as a single-piece construction. Spacer support 5 itself can also be of single piece construction. In a preferred embodiment, spacer support 5 is clear rigid PVC material with UV protection; however, any suitable material such as plastic, metal, wood and/or the like is within the scope of the present invention.

Figure 4:
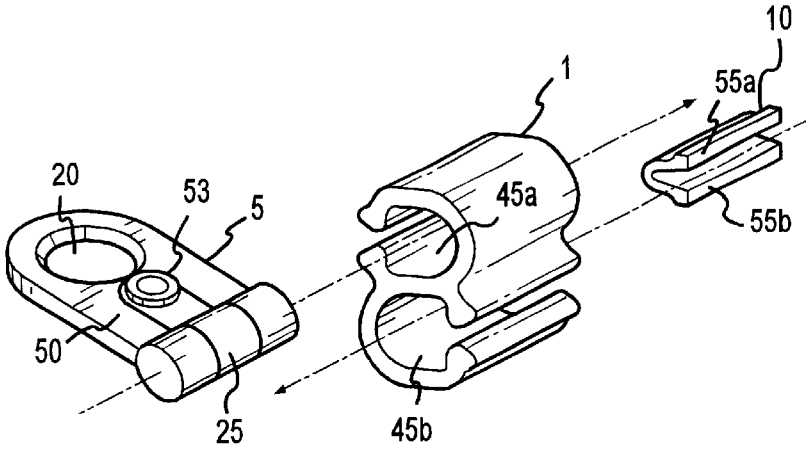
FIG. 4 is a three-quarter perspective, exploded view of an exemplary sheet-material mounting apparatus depicting the positional relationship of the component parts according to one embodiment of the present invention.

With reference to FIGS. 2A and 4, a planar flange 50 is attached to the longitudinal surface of either cylindrical end 27 or cylindrical end 25, respectively, such that flange 50, when spacer support 5 is inserted into channel 45*a*, protrudes outwardly from the channel opening 30*a*. In a preferred embodiment, spacer flange 50 includes an aperture 20 which receives lift cord 65 therethrough. The lift cord aperture 20 is positioned on the spacer flange 50 at a predetermined distance away from either cylindrical end 27 or cylindrical end 25, respectively. In a preferred embodiment, spacer support 5 is molded around spacer cord 70, thereby providing a secure attachment between cord 70 and spacer support 5. In a particularly preferred embodiment, spacer support 5 includes a cylindrical projection 53 which extends above and below spacer support 5. In this embodiment, cylindrical projection 53 is also molded around spacer cord 70, thereby increasing the support by spacer support 5 around spacer cord 70. Cylindrical projection 53 may be any suitable material, may project above and/or below spacer support 5, may be molded as a single unit with spacer support 5, may beta separate component (such as a dowel, washer, etc.) and may be located anywhere on spacer support 5. One skilled in the art will appreciate that the present system can include more than one lift cord 65 or more than one spacer cord 70 and aperture 20 can be of any size, located anywhere on spacer 5, additional apertures can exist on spacer support 5 or cords 6S, 70 may be suitably attached, by clip, glue and/or the like, to any portion of the spacer support 5. Moreover, spacer support 5, or any portion of spacer support 5, may be formed around, and fused to, spacer cord 70 and/or lift cord 65, thereby eliminating the need for the aperture 20.

With particular reference to FIGS. 2B and 4, spacer 5 preferably includes an elliptical nocth 54 on either the cylindrical end 27 or the cylindrical end 25, respectively, which receives a plate 52. Notch 54 preferably includes a protruding, convex ridge along its inner circumference for receiving the side-slotted groove along the outer circumference of the side surface of plate 52. Plate 52 is preferably an elliptical device with a first rounded end with a flat upper and lower surface and a second enlarged cylindrical end 27 or 25 which, in the case of cylindrical end 27, tapers down on its outside edge, thereby forming an arrowhead like configuration. In a preferred embodiment, if a spacer cord 70 is used, plate 52 and cylindrical projection 53 (as discussed above) is molded around spacer cord 70 such that spacer cord 70 travels through the flat upper and lower surface of plate 52. One skilled in the art will appreciate that the plate 52 and notch 54 configuration can be any configuration and can include any suitable means for attaching plate 52 to spacer support 5 (groove, clip, etc.), or alternatively, spacer support 5 can be a one piece configuration without a removable plate 52.

More particularly, if it is desired that sheet material 60 lay flat without pleating or the like (for example, in the case of sheet material 60 comprising a detailed pattern), plate 52 and spacer cord 70 may be eliminated from the system. However, if pleating or the like is desired (for example, in the case of sheet material 60 comprising a solid color), the incorporation of plate 52 and spacer cord 70 into spacer support 5 helps form the pleats.

Figure 3:
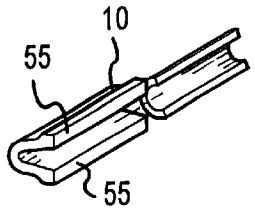
FIG. 3 is a three-quarter perspective view of a portion of an exemplary rod according to one embodiment of the present invention.
Figure 6:
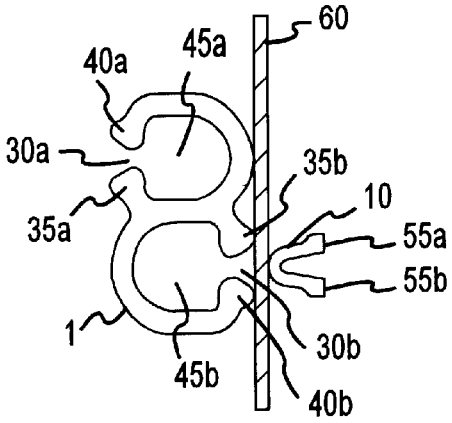
FIG. 6 is a side elevation view of an exemplary shade clamp prepared to receive a welting of sheet material for subsequent gripping with a rod according to one embodiment of the present invention.

Rod 10 is any device configured for securing sheet material 60 within the mounting channel 45*b* of the shade clamp 1. As best shown in FIG. 3 (which shows a portion of the elongated rod 10 in a v-spring clip embodiment), rod 10 is preferably one piece having the same length as the width of the shade. Alternatively, rod 10 is many clips, rods or the like which are inserted into mounting channel 45*b* at various locations. Rod 10 is preferably a v-spring having depressible wings 55*a*, 55*b* for releasably securing a welting of the sheet material 60. As best shown in FIG. 6, the v-spring wings 55*a*, 55*b* are compressed to collapse the rod 10 for subsequent insertion into the mounting channel 45*b* through the mounting channel lateral opening 30*b*. After insertion into channel 45*b*, the rod 10 is released and the wings 55*a*, 55*b* expand to provide a force against the inner surface of channel 45*b*, thereby sandwiching the sheet material 60 in channel 45*b* and restricting the movement of sheet material 60. Those skilled in the art will also recognize various other means and shapes that may be alternatively or conjunctively used which are within the scope of the present invention, such as, for example, a rod, a pin, clasp, VELCRO™, adhesive, snaps and/or the like. Alternatively, rod 10 could be eliminated and material 60 can be wrapped around the outside of mounting channel 45*b* and optionally clamped to the outside of mounting channel 45*b* by any of the aforementioned clamping devices.

Figure 5:
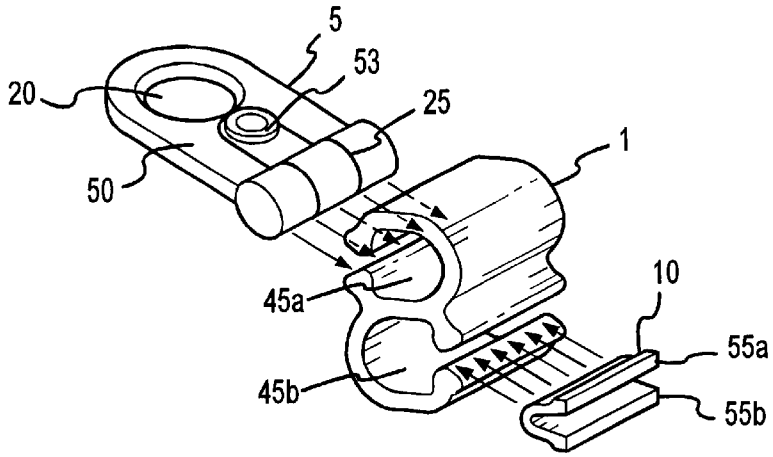
FIG. 5 is a three-quarter perspective view with arrows depicting an exemplary method of receivably engaging a v-spring and spacer within opposed shade clamp channels according to one embodiment of the present invention.

The positional arrangement of the component parts of the sheet material mounting apparatus is best shown in FIG. 4. Spacer support 5 receivably engages through side insertion into spacer channel 45*a* of shade clamp 1 and the rod 10 receivably engages through side insertion the mounting channel 45*b* of the clamp 1. An alternative method of receivably engaging both the spacer support 5 and the rod 10 in their respective channels 45*a*, 45*b* is shown by the arrows of FIG. 5 wherein the components are pushed into their respective channels through openings 30*a*, 30*b*, respectively. Those skilled in the art will also recognize various other methods that may be alternatively or conjunctively used which are within the scope of the present invention, such as any arrangement or methods for receivably engaging, such as, for example, rotating the components into the channels, permanent single-piece construction and/or the like.

Figure 7:
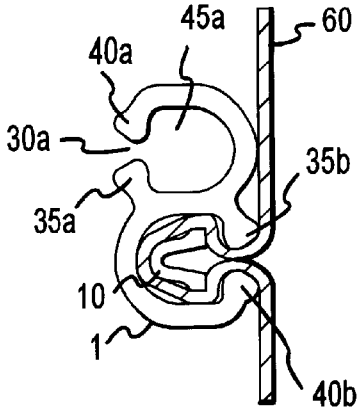
FIG. 7 is a side elevation view of an exemplary shade clamp having receivably engaged a v-spring and a welting of sheet material according to one embodiment of the present invention.

As is best shown in FIG. 6, prior to receivably engaging a welting of sheet material 60, the sheet material 60 is placed between the mounting channel 45*b* and the rod 10. As the upper wing 55*a* and lower wing 55*b* of the rod 10 are compressed, the rod 10 is pushed through the lateral opening 30*b* of the mounting channel 45*b* or slid trough the side forcing a welting of fabric 60 into the mounting channel 45*b* as shown in FIG. 7. Alternatively, a welting of sheet material 60 can be wrapped around the exterior surface of the rod 10 and then depressed and forced through the lateral opening 30*b* (or slid through the side).

With the guide spacer channel 45*a* opening the opposite direction to the sheet-material mounting channel 45*b*, the receivably engaged spacer support 5 is positioned to bear a large percentage of the weight of the sheet material 60 at a point approximately directly above the point of sheet material attachment within channel 45*b*. This configuration positions the center of gravity of the apparatus more directly above the mounting channel 45*b* which has the effect of reducing asymmetric tilting of the sheet-material mounting apparatus as the lift cord 70 is raised. This in turn reduces the friction incident upon the lift cord 70 as the shade travels through raised positions and reduces the pulling force needed to lift the shade.

Figure 8:
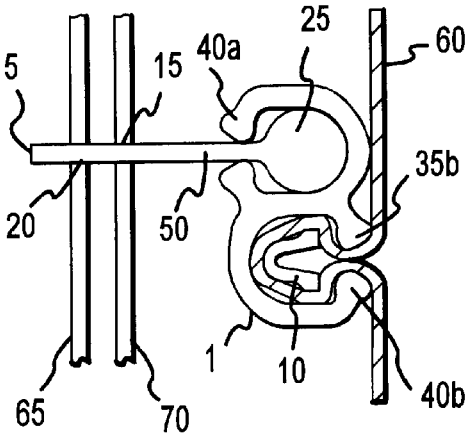
FIG. 8 is a side elevation view of an exemplary shade clamp attached to a support structure and having receivably engaged a v-spring, a welting of sheet material and a spacer, wherein the spacer includes a lift cord and spacer cord, according to one embodiment of the present invention.

One method of attachment of clamp 1 to the support structure of a lift cord 65 and spacer cord 70 is shown in FIG. 8. As the lift cord 65 is raised, the spacer support 5 is engaged at a predetermined point to raise and travel with the lift cord 65. The spacer cord 70 is a static line that provides a guide for a plurality of spacers supports 5 to travel along as the shade is moved through raised positions. The spacer cord 70 also assists with preventing torquing of the spacer supports 5 as the lift cord 65 is raised.

Figure 9:
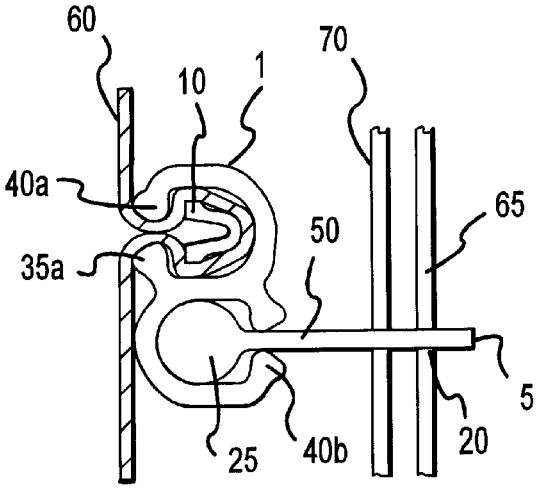
FIG. 9 is a side elevation view of an exemplary shade clamp attached to a support structure and having receivably engaged a v-spring, a welting of fabric and a spacer, wherein the spacer includes a lift cord and spacer cord, according to an alternative embodiment of the present invention.
Figure 10:
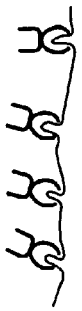
PRIOR ART FIG.10
FIG. 10 is a side view of a prior art device showing the asymmetric tilting of the gripping devices.

FIG. 9 shows an alternative configuration for reducing friction incident upon the lift cord 70. In this alternative embodiment of the present invention, the receivably engaged spacer support 5 is positioned to bear the weight of the sheet material 60 at a point directly below the point of sheet material attachment to mounting channel 45*b*. This configuration positions the center of gravity of the apparatus more directly below the mounting channel 45*b* which similarly has the effect of reducing asymmetric tilting of the sheet-material mounting apparatus as the lift cord 65 is raised. The alternative embodiment of the present invention depicted in FIG. 9 reduces the friction incident upon the lift cord 65 as the shade travels through raised positions as well.

Figure 11C:
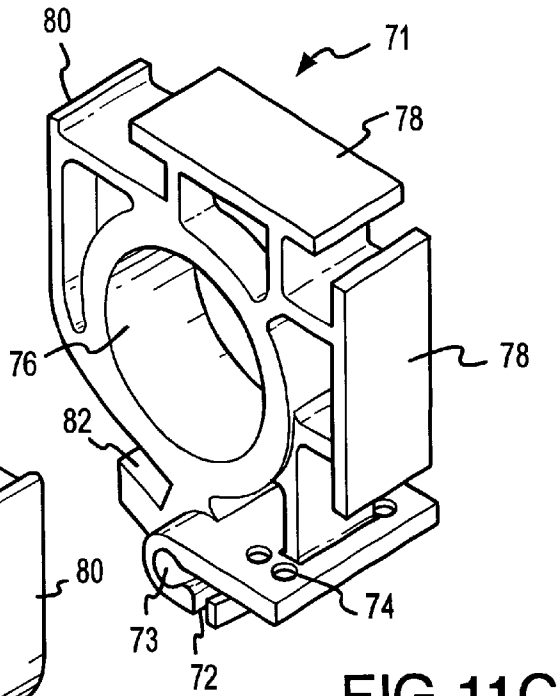
FIG. 11C is a rear view of a center support bracket according to one embodiment of the present invention.
Figure 11B:
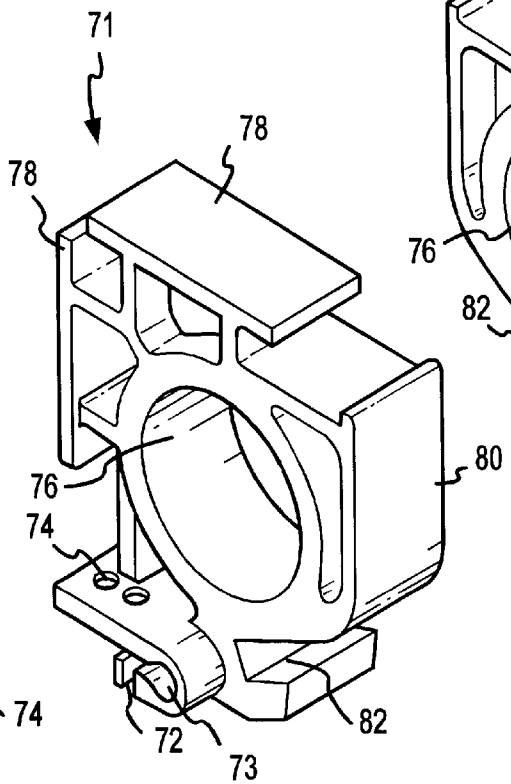
FIG. 11B is a front view of a center support bracket according to one embodiment of the present invention.
Figure 11A:
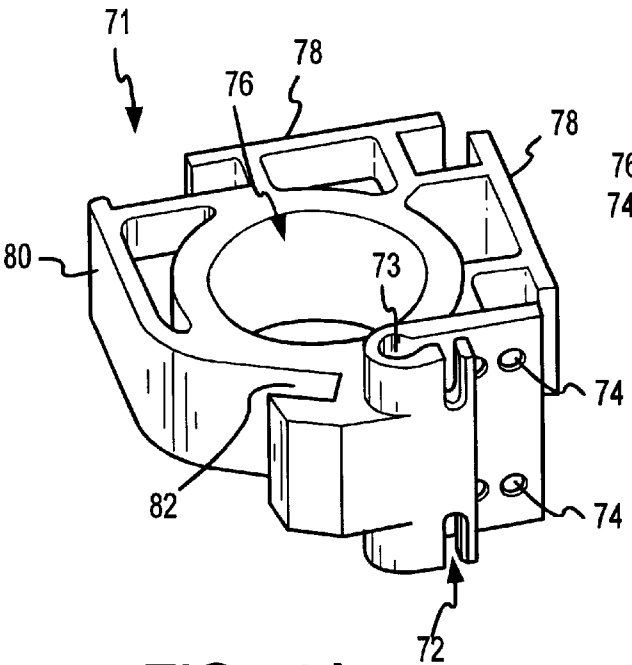
FIG. 11A is a bottom view of a center support bracket according to one embodiment of the present invention.

With respect to FIGS. 11A–C, various views of a center support bracket 71 is shown. Center support bracket 71 is any suitable device configured to support the lift tube 112 (shown in FIG. 13), housing 90, facie 110 (shown in FIG. 13), spacer support 5 and fabric mount while providing a guide for the lift cords 65. One skilled in the art will appreciate that bracket 71 is of any configuration and comprised of any suitable material Moreover, bracket 71 can be one molded multi-functional component or can be a plurality of components which perform one or more of the aforementioned functions. In a preferred embodiment, bracket 71 includes a central circular opening 76 for supporting the lift tube 112. Top and rear rectangular plates 78 are attached to opening 76 by a lattice structure which is perpendicular to the surface of opening 76. Rectangular plates 78 include lips around its periphery such that plates 78 are suitably configured to attach bracket 71 to housing 90 by slidably engaging the lips into channels 94. The front of bracket 71, as best seen in FIG. 11B, preferably includes a rectangular facie plate 80 with a lip on its periphery for slidably engaging facie. One skilled in the art will appreciate that plates 78 and 80 can attach to other parts by any suitable means, including for example, snaps, VELCRO™, adhesives and/or the like, or can be integral with the other components. Below plate 80, towards the bottom of bracket 71, is an angled ledge 82 which is configured to support the fabric mounting spline. As best seen in FIG. 11A, below ledge 82, and on the bottom of bracket 71, are two opposing notches 72 which open to the outside surfaces of bracket 71 and a circular slot 73. Notches 72 and slot 73 are suitably configured to retain spacer support 5. Also on the bottom of bracket 71 and further towards the rear surface, are preferably four apertures 74 which are suitably configured to guide the lift cord 65, wherein two of the holes on the same side are for two different cords depending on the left or right configuration of the cords.

Figure 12:
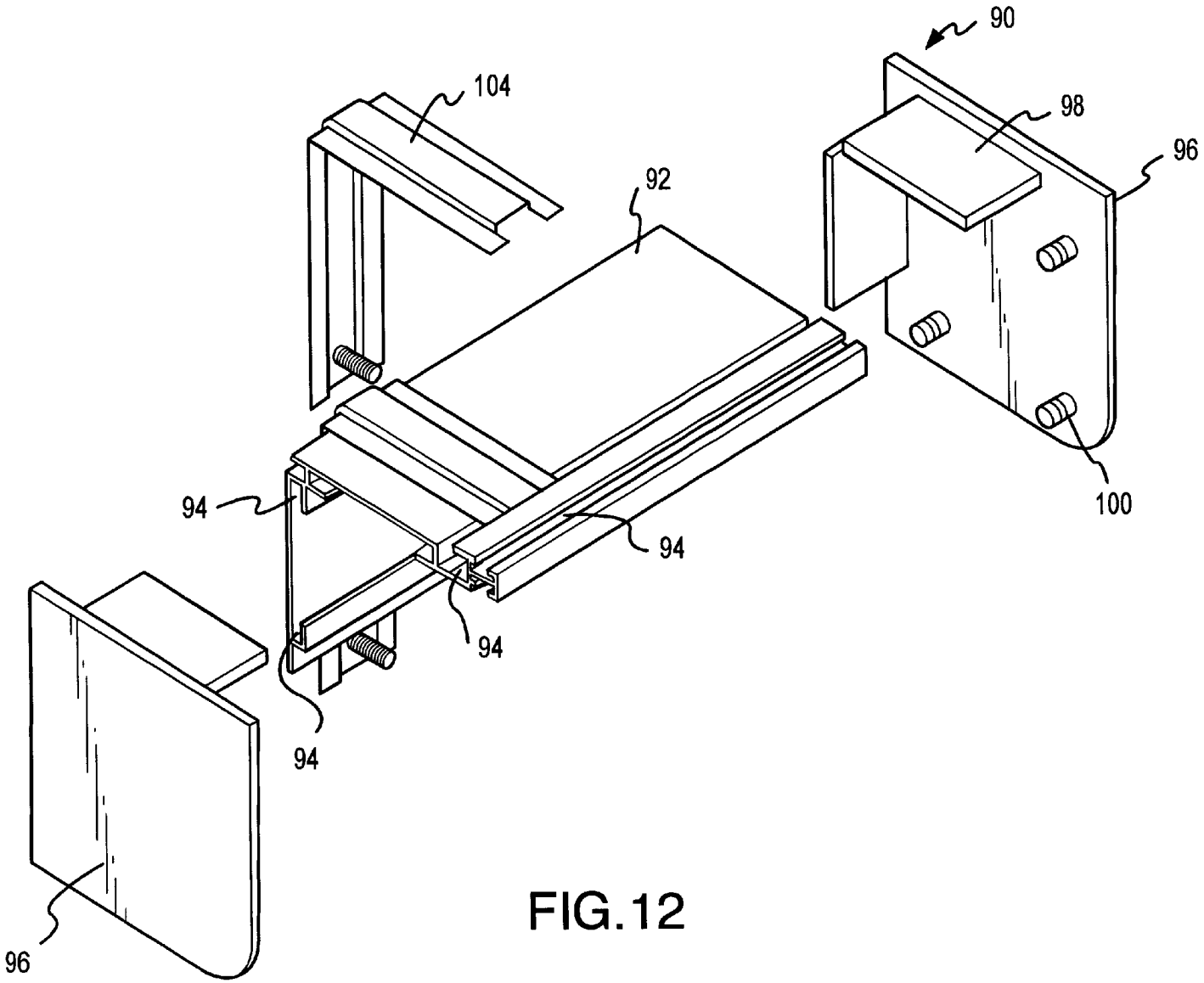
FIG. 12 is an exploded view of the housing assembly showing the end caps and wall brackets according to one embodiment of the present invention; and, FIG. 13 is a side cut-away view of a support assembly showing a center support bracket, housing and shade clamp according to one embodiment of the present invention.

With respect to FIG. 12, an exemplary housing assembly 90 is shown. Housing assembly 90 is any suitable device or combination of devices in any suitable configuration for supporting center bracket 71 and facie 110 and comprised of any suitable material such as plastic, PVC, metal, aluminum, wood, and/or the like. In a preferred embodiment, housing 90 includes L-shaped plate 92 comprised of extruded aluminum, end caps 96 comprised of plastic and wall brackets 104 comprised of metal. Plate 92 includes various channels 94 for slidably engaging plates 78 and 80 of center bracket 71, wall bracket 104 and plates 98 of end caps 96. End caps 96 preferably include plates 98 for slidably engaging plate 92 and pins 100 for attaching to the shade drive end bracket.

Those skilled in the art will recognize that the invention is not limited to merely those embodiments, features, materials and aspects which have been affirmatively recited herein; other variations, modifications, and alternative embodiments may be made without departing from the scope of the present invention.

What is claimed is:

1. A clamp for supporting sheet material, the clamp comprising:

a mounting channel including a mounting channel opening disposed therein for receiving at least one of a welting of sheet material and means for securing the welting of sheet material within said mounting channel; and a spacer channel positioned either above or below said mounting channel, said spacer channel dimensioned similarly to said mounting channel and having a spacer channel opening disposed therein for receiving a spacer support configured for attachment to a support structure, wherein said spacer channel opening faces in a direction directly opposite a direction in which said mounting channel opening faces.

2. The clamp of claim 1, wherein said spacer channel comprises means for releasably engaging the spacer support.

3. The clamp of claim 1, wherein the means for securing the welting of sheet material within said mounting channel is releasably engageable.

4. The clamp of claim 3, wherein said means for securing the welting of sheet material within said mounting channel comprises a rod.

5. The clamp of claim 1, wherein a side view of the clamp resembles either an "S" or a reverse "S" configuration.

6. The clamp of claim 1, wherein said means for securing the welting of sheet material within said mounting channel comprises a V-spring clip.

7. A spacer support for a shade system, the spacer support comprising:

a planar portion having a first end and a second end, said planar portion comprising at least one aperture at said first end for receiving a first cord there through;

a mating portion having a first surface and a second surface, wherein said first surface is coupled to said second end of said planar portion and said second surface comprises a tapered edge; and a removable portion disposed at said second end of said planar portion, wherein said removable portion is configured to engage a second cord.

8. A shade system comprising:

at least one support means for supporting shade components;

a welting of sheet material having a first end and a second end, said first end coupled to said support means;

at least one cord in operative association with said support means and configured for at least one of raising and lowering said welting of sheet material;

a spacer support in operative association with said at least one cord, said spacer support comprising:

a planar portion having a first end and a second end, said planar portion comprising at least one aperture at said first end for receiving said at least one cord there through;

a mating portion having a first surface and a second surface, wherein said first surface is coupled to said second end of said planar portion and said second surface comprises a tapered edge; and a removable portion disposed at said second end of said planar portion, wherein said removable portion is configured to engage at least one cord; and a mounting clamp coupled to said welting of sheet material and said spacer support, said mounting clamp comprising:

a mounting channel including a mounting channel opening disposed therein for receiving at least one of said welting of sheet material and a means for securing the welting of sheet material within said mounting channel; and a spacer channel positioned either above or below said mounting channel, said spacer channel having a spacer channel opening disposed therein for receiving said mating portion of at least one spacer support, wherein said spacer channel opening faces in a direction directly opposite a direction in which said mounting channel opening faces.

9. A shade system comprising;

at least one support means for supporting shade components;

a welting of sheet material having a first end and a second end, said first end coupled to said support means;

a lift cord in operative association with said support means and configured for at least one of raising and lowering said welting of sheet material;

a spacer cord in operative association with said support means;

a mounting clamp coupled to said welting of sheet material, said mounting clamp comprising:

a mounting channel including a mounting channel opening disposed therein for receiving at least one of said welting of sheet material and a means for securing the welting of sheet material within said mounting channel; and a spacer channel positioned either above or below said mounting channel, said spacer channel dimensioned similarly to said mounting channel and having a spacer channel opening disposed therein for receiving at least one spacer support, wherein said spacer channel opening faces in a direction directly opposite a direction in which said mounting channel opening faces; and a spacer support in operative association with said mounting clamp, said lift cord, and said spacer cord, said spacer support comprising:

a planar portion having a first end and a second end, said planar portion comprising at least one aperture at said first end for receiving said lift cord there through;

a mating portion having a first surface and a second surface, wherein said first surface is coupled to said second end of said planar portion and said second surface comprises a tapered edge; and a removable portion disposed at said second end of said planar portion, wherein said removable portion is configured to engage said spacer cord.

* * * * *